US007063752B2

(12) United States Patent
Koo et al.

(10) Patent No.: US 7,063,752 B2
(45) Date of Patent: Jun. 20, 2006

(54) GRAIN REFINEMENT OF ALLOYS USING MAGNETIC FIELD PROCESSING

(75) Inventors: Jayoung Koo, Bridgewater, NJ (US); Shiun Ling, Washington, NJ (US); Michael John Luton, Bedminster, NJ (US); Hans Thomann, Bedminster, NJ (US); Narasimha-Rao Venkata Bangaru, Annandale, NJ (US)

(73) Assignee: ExxonMobil Research and Engineering Co., Annandale, NJ (US)

( * ) Notice: Subject to any disclaimer, the term of this patent is extended or adjusted under 35 U.S.C. 154(b) by 197 days.

(21) Appl. No.: 10/314,620

(22) Filed: Dec. 9, 2002

(65) Prior Publication Data

US 2003/0155039 A1 Aug. 21, 2003

Related U.S. Application Data

(60) Provisional application No. 60/340,311, filed on Dec. 14, 2001.

(51) Int. Cl.

| | |
|---|---|
| ***H01F 1/04*** | (2006.01) |
| ***H01F 1/14*** | (2006.01) |
| ***C21D 1/04*** | (2006.01) |

(52) U.S. Cl. ..... 148/108; 148/103; 148/565; 148/674; 148/675

(58) Field of Classification Search ..... 148/103, 148/108, 565, 674, 675
See application file for complete search history.

(56) References Cited

U.S. PATENT DOCUMENTS

| | | | | |
|---|---|---|---|---|
| 4,591,393 A | | 5/1986 | Kane et al. | 148/11.5 N |
| 4,908,069 A | | 3/1990 | Doherty et al. | 148/2 |
| 5,143,563 A | | 9/1992 | Krueger et al. | 148/410 |
| 5,169,463 A | | 12/1992 | Doherty et al. | 148/501 |
| 5,885,370 A | * | 3/1999 | Shimotomai et al. | 148/108 |
| 6,773,513 B1 | * | 8/2004 | Ludtka | 148/108 |

FOREIGN PATENT DOCUMENTS

| | | | | |
|---|---|---|---|---|
| EP | 0826782 A2 | | 3/1998 | |
| EP | 1031632 A2 | | 8/2000 | |
| JP | 11-269611 | * | 10/1999 | |
| WO | WO 02/064847 A1 | * | 8/2002 | 148/312 |

OTHER PUBLICATIONS

Machine Translation of Japanese Patent Document No. 11–269611, cited above in Foreign Patent Documents section.*

H.D. Joo, S.U. Kim, N.S. Shin, Y.M. Koo: "An effect of high magnetic field on phase transforma–tion in Fe–C system" Materials Letters, vol. 43, May 2000, pp. 225–229, XP002232281; p. 228, right–hand column, line 8–16; figure 4; table 1 p. 229, left–hand column, line 2–10.

G. Inden, "The Role of Magnetism in the Calculation of Phase Diagrams" 1981, pp. 82–100, Physica 103B.

* cited by examiner

*Primary Examiner*—John P Sheehan
(74) *Attorney, Agent, or Firm*—Paul E. Purwin; Robert A. Migliorini

(57) ABSTRACT

A method for refining the grain size of alloys which undergo ferromagnetic to paramagnetic phase transformation and an alloy produced therefrom. By subjecting the alloy to a timed application of a strong magnetic field, the temperature of phase boundaries can be shifted enabling phase transformations at lower temperatures.

22 Claims, 5 Drawing Sheets

GRAIN REFINEMENT OF ALLOYS USING MAGNETIC FIELD PROCESSING

CROSS-REFERENCE TO RELATED APPLICATION

This application claims the benefit of U.S. Provisional Application No. 60/340,311 filed Dec. 14, 2001.

FIELD OF THE INVENTION

The present invention relates to the production of refined grain structures in structural alloys. The refined grain structures are useful in designing superior structural alloys with step-out combination of mechanical properties such as strength and toughness. The invention includes the application of a high strength magnetic field to shift the phase boundaries of alloys and thereby induce phase transformation. The method includes the alternate application and cessation or decrease in strength of such magnetic field and the attendant rapid forward and reverse phase transformation leading to progressive refinement of the initial coarse grain structure of the alloy into fine equiaxial grains. Equiaxial or equiaxed grains or crystallites have approximately equal dimensions in the three coordinate directions.

BACKGROUND OF THE INVENTION

Increasing the strength of structural alloys is highly desired as it allows thinner wall construction for load bearing structural members or for vessels used for containing pressurized fluids. Thinner wall construction can lead to significant economic incentives due to material, fabrication, transportation and erection cost savings. In other applications, high strength structural materials provide enabling technologies, for instance, structural steel components for ultra-deep water drilling and production of hydrocarbons. However, before the strength potential of a higher strength structural material or alloy can be fully utilized in engineering design, it is critical that the material possesses adequate toughness to resist brittle fracture. It is known to those skilled in the art that, in the case of structural alloys, reducing the alloy's grain size can enhance simultaneously both the strength and toughness properties.

There are a number of approaches adopted in the past to refine the grain size of structural alloys. All of these approaches are based on controlled nucleation and growth of fresh grains via thermal or thermo-mechanical means to alter the stability of phases and/or by making the existing phases unstable.

In one commonly used approach, for example, temperature or material-chemistry is changed to move the material from one phase region, across existing phase boundaries, into another phase region. Each of the phase regions may have one or more stable phases. In these processes, however, the phase boundary and the phase free energies are not fundamentally altered.

For instance, in one approach, refinement of the alloy grain size is achieved by inducing phase transformation via thermal cycling the alloy across phase boundaries. Such thermal cycling treatments have been used effectively for grain refinement in several Fe—Mn and Fe—Ni steels used in cryogenic applications. For instance, U.S. Pat. No. 4,257,808 describes a thermal cycling treatment method for producing ultra-fine grain structure in low Mn alloy steel for cryogenic service. The technical and scientific basis for thermal cycling treatment is also described in the publication, "Grain Refinement Through Thermal Cycling in an Fe—Ni—Ti Cryogenic Alloy", S. Jin et al., Metallurgical Transactions A, vol. 6A, 1975, pp. 141–149. This thermal cycling method uses existing phase boundaries. The phase boundary is not altered, nor is the phase free energy changed.

U.S. Pat. No. 5,413,649 proposes cycling the temperature between different phase regions of one of the components in a composite material. This induces phase transformation in that component, and provides grain refinement and superplasticity. This method uses existing phase boundary. The phase boundary is not altered, nor is the phase free energy changed.

In another widely used approach in high strength low alloy steels, austenite grains are refined by multi-step controlled hot working process, such as hot rolling, at sufficiently high temperatures to induce dynamic and/or static recrystallization to progressively refine the initial coarse austenite grains. Since this involves simultaneous application of both heat and mechanical deformation, this approach is also known as thermo-mechanical treatment (TMT) or processing. In most instances of TMT processing, microalloying with grain growth restraining alloy additions such as Nb or mixtures of Nb, Ti are used to further control the recrystallization and subsequent growth of the recrystallized grain. Numerous patents and publications are in the art describing both the science and practice of this technology for designing commercially attractive alloys with superior structural properties. For example, technical publication, "Processing-Thermomechanical Controlled Processing" by I. Kozasu, pp. 183–217 in "Materials Science and Technology" series edited by R. W. Cahn et al. in volume 7 "Constitution and Properties of Steels" edited by F. B. Pickering and published in 1992 by VCH, New York, provides the mechanisms and processes related to TMT. U.S. Pat. No. 6,254,698 "Ultra-High Strength Ausaged Steels with Excellent Cryogenic Temperature Toughness" describes the use of specific TMT to produce ultra-fine austenite grains.

There are also other approaches for refining grain size. This includes the cold work followed by high temperature annealing to recrystallize the heavily deformed grains. There is no phase transformation involved in this case; new grains of the same crystal structure nucleate and grow to replace the heavily deformed, unstable grains from the cold work. Since this is a thermally activated process, higher temperatures accelerate the formation of new grains. For instance, U.S. Pat. No. 5,534,085 proposes forging an alloy at low temperature, then heating the alloy to high temperature where recrystallization occurs to release the stored strain energy, thus achieving a fine and uniform microstructure. This process does not involve phase transformation.

U.S. Pat. No. 5,080,727 proposes heating a plastically deformed material to high temperature that destabilizes the low temperature phase. This results in a fine microstructure due to phase transformation induced recrystallization (presumably with increased kinetics driven by the stored strain energy). This method uses existing phase boundaries. The phase boundary is not altered, nor is the phase free energies changed.

U.S. Pat. No. 6,042,661 proposes changing the material chemistry to move it from an initial phase region into a different phase region, thus inducing phase transformation that results in superplasticity. Again, this method uses existing phase boundaries. The phase boundary is not altered, nor is the phase free energies changed.

U.S. Pat. No. 3,723,194 proposes rapidly heating a material from its initial $\alpha$ state to a temperature inside the $\alpha+\gamma$ dual phase region, thus inducing instability that provides superplasticity. This method uses existing phase boundary. The phase boundary is not altered, nor is the phase free energies changed.

U.S. Pat. No. 5,087,301 proposes rapidly cooling a molten alloy to form a solid supersaturated with a specific solute. The alloy is subsequently heated to a higher temperature (presumably to provide solute atoms with sufficient diffusivity) at which the solute precipitates out in the form of intermetallic particles. This process does not involve phase transformation.

U.S. Pat. No. 4,466,842 proposes hot rolling steel when cooling from $\gamma$ to $\alpha+\gamma$ dual phase regions. This results in fine grain size due to two simultaneous processes, which include the $\gamma$ to $\alpha$ phase transformation and the strain induced $\gamma$ recrystallization. This method uses an existing phase boundary. The phase boundary is not altered, nor is the phase free energy changed.

The limitation with current methods for grain refining is concerned with the conflicting requirements for efficient and uniform grain refinement: high nucleation rate for new grains and no grain growth. A high nucleation rate is promoted by high thermodynamic driving force. For this, a large temperature change, $\Delta T$, is required. To avoid grain growth, the temperature change should be instantaneous. However, this is very difficult to achieve in practice in large components that typify commercial applications. For these components the temperature change is only gradual even with the state-of-the-art commercial heating or cooling processes. The gradual change in temperature results in nucleation of some new grains of the new phase at the early stages of this temperature change. Upon continued change in temperature, the alloy or material transitions more into the new phase primarily by the growth of the existing nuclei to fairly coarse sizes, which is favored over further nucleation. Thus, rapid heating or cooling of the material is required to fully take advantage of all the driving force resulting from temperature change to promote nucleation and discourage growth. However, due to the limitations of finite heating and cooling rates in actual practice, the smallest grain size achievable by state-of-the-art techniques is limited to about 10 micrometers for equiaxed grains. There is considerable technological interest in further refining the grains down to less than 10 micrometers, preferably to less than about 5 micrometers, and even more preferably to less than about 1 micron. A new material processing methodology without the aforementioned limitations of current techniques is required to produce grain size refinement to less than 10 micrometers.

SUMMARY OF THE INVENTION

The invention includes a method for refining the grain size by applying a magnetic field in alloys to reversibly induce phase transitions between ferromagnetic and paramagnetic phases. Other magnetic phases are envisioned but less preferred. This phase transformation can be induced by changes in application of a magnetic field with or without a change in temperature. This invention is based on the effect of a magnetic field fundamentally lowering the free energies and enhancing the thermodynamic stability of the ferromagnetic phase(s), resulting in shifting of the phase boundaries. For this invention the two phases (e.g., ferromagnetic and paramagnetic phases) have different chemistries and/or preferably different crystalline structures and transition from one phase to the other phase requires a chemistry (e.g., precipitates) and/or crystalline structure change. The magnetic field is applied and ceased or decreased for one or more cycles to obtain the desired equiaxed grain size. The number of cycles is preferably less than 100, more preferably less than 10, even more preferably less than 5. The time between cycles is preferably about the same as the time the magnetic field is applied, but can be up to 10 times shorter or greater. Ramping time during increasing or decreasing the magnetic field is preferably minimized. Ramp up and ramp down times for 5%⇆95% of the peak magnetic field are preferably less than 10 seconds, more preferably less than 5 seconds, and even more preferably less than 1 second. The magnetic field can be stepped up and/or down (preferably in one step) or ramped up and/or down. For example as seen in FIG. 4, the magnetic field can be increased and/or decreased in either a single or multiple steps. The phase boundary temperature is shifted up (with increasing magnetic field) or reverted (with decreasing magnetic field) so that the equilibrium ratio of different phases changes. Ratios can be measured by volume ratios, wherein a single phase has a ration of, for example, 100%:0%. Hence, the invention is directed to a method for refining the equiaxed grain size of an alloy which undergoes a ferromagnetic to paramagnetic transition comprising (a) subjecting said alloy to a magnetic field of a sufficient strength and for a time sufficient to cause said alloy to transition from its original initial phase ratio (condition A) to a new phase ratio (condition B), and (b) decreasing said magnetic field to allow said alloy to transition to yet a different phase ratio (condition C), wherein said condition C may be the same or different from said condition A, and optionally repeating steps (a) and (b). The decreasing of magnetic field in (b) may include reducing the magnetic field to zero as well as changing it to a strength different from that in (a).

The invention produces a metal or alloy, at the high temperature chosen for magnetic processing, having fine equiaxed grain size of less than 10 micrometers, preferably less than about 5 micrometers, and even more preferably less than about 1 micron. In a preferred embodiment, the alloy is cooled (e.g., ambient air cooling, fast quenching in a fluid medium, accelerated cooling in a medium) after magnetic processing to below about 500–550° C. to minimize grain growth. In another embodiment, said fine equiaxed grain metal or alloy can be subjected to subsequent processing by conventional methods to further reduce the grain size. Said conventional processing includes high temperature processing (e.g., thermo-mechanical controlled processing—TMCP, hot rolling, hot bending, hot forging, etc.) and cooling from high temperature to ambient or some temperature in between. In addition to grain size and shape, the materials produced by this invention can have improved grain distribution, and surfaces.

Furthermore, the invention is broadly directed to metals or alloys which undergo ferromagnetic to paramagnetic phase transitions. The invention is preferably suited to alloys of Fe, Ni, and Co, individually or in combination (e.g., Fe—Ni—Co alloys), and with or without carbon. Impurities or minor alloying may be allowed per conventional engineering practice. Without limiting this invention, said impurities or minor alloying may include S, P, Si, O, N, Al, etc. In particular, this invention is suited for carbon and low alloy steels including high strength low alloy (HSLA) steels. For the purpose of this invention, HSLA steels are Fe based steels with less than about 8 wt % total alloying content.

DETAILED DESCRIPTION OF THE INVENTION

Although the embodiments of the present invention are described in the following using its application to carbon and low alloy steels, it would be obvious to those skilled in the art that the invention has broad applicability to any alloy which displays magnetic phase transitions, preferably ferromagnetic ⇆ paramagnetic phase transitions. The alloys of the invention with refined equiaxed grain size which are produced by the invention described herein may be used to fabricate structural components and processing equipment such as pressure vessels. These structures and equipment have applications such as in oil and gas exploration, oil and gas production, refining processing, and chemical processing. The refined grain alloys produced herein provide stronger and tougher materials out of which structural components can be fabricated. Beneficially, alloys with equiaxed grain size of less than 10 micrometers at high temperature can be produced. Said alloys can be further processed by conventional methods including high temperature processing (e.g., TMCP, and other hot deformation such as rolling, bending, forging, etc.) and cooling to ambient or other temperature in between.

Figure 1:
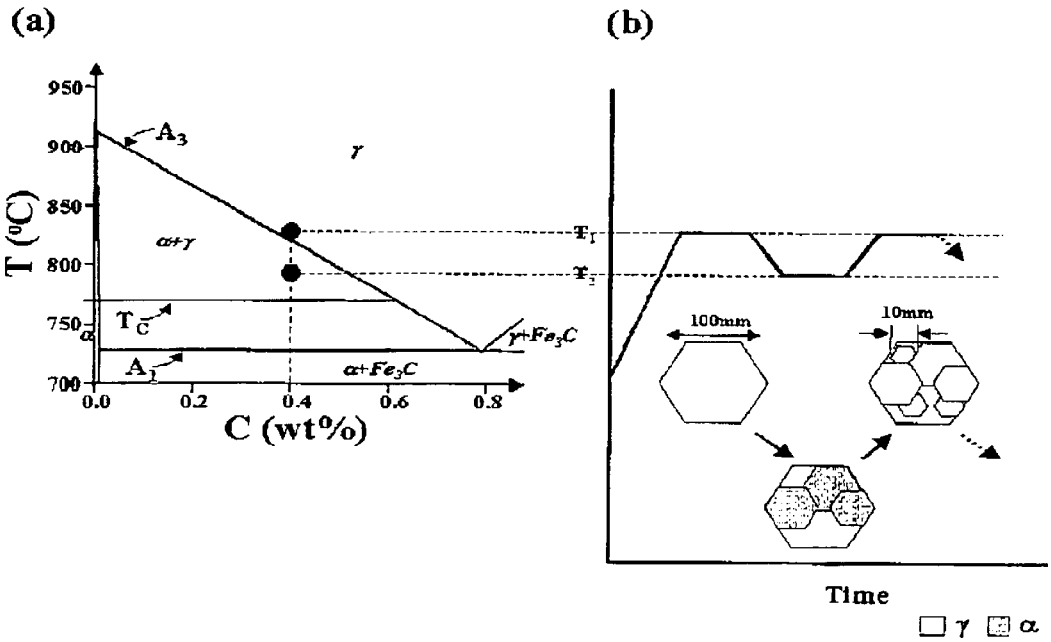
PRIOR ART Figure 1
FIG. 1 shows the Fe—C phase diagram and a schematic depicting the prior art approaches to refine the grain structure of austenite or gamma ($\gamma$) phase at high temperature.

In prior art approaches, repeated thermal cycling to change a phase ratio, for instance, between the single phase $\gamma$ and two phase ferrite ($\alpha$)+$\gamma$ regions across existing phase boundaries of a carbon steel will lead to production of a certain $\alpha$ to $\gamma$ phase ratio and its reverting back to form 100% $\gamma$ phase in one thermal cycle. This forward and reverse phase transformations take place by nucleation and growth of the stable phase consuming the unstable phase. These repetitions produce the grain refining depicted in the schematic of FIG. 1. Each time there is a nucleation stage, typically there are more than one nuclei formed thereby breaking up the pre-existing grains into smaller units or grains. Upon repeated thermal cycling across the phase boundary regions, the original coarse grain structure is broken up into fine grains as shown in the schematic of FIG. 1. The state-of-the-art technology is limited to equiaxed grain size refinement to about 10 micrometers (at the processing temperature) due to the limitations in rapidity with which the thermal cycles can be accomplished in existing commercial heat treatment facilities. This is primarily limited by the time required for heat-up and cool-down cycles and the ensuing growth of existing grains over fresh nucleation during this time period.

In the present invention, the phase transitions between two different phase regions are accomplished at a temperature preferably no more than about 100° C. above the curie temperature ($T_C$). In the absence of an external magnetic field a ferromagnetic material becomes paramagnetic above the Curie temperature. In the $\alpha$+$\gamma$ phase region of steel shown in phase diagrams, it is also possible to move within the same phase region but with differing volume fractions or phase ratios of the constituent phases. The temperature may be fixed or may vary within the noted range during application of the magnetic field. Therefore, the temperature during application of the magnetic field can be fixed at any temperature from $A_1$ up to a temperature equal to $T_C$ plus 100° C. or may vary within this range. $A_1$ for steels is the temperature of the boundary between the $\alpha$+$\gamma$ phase region and the $\alpha$ or $\alpha$+$Fe_3C$ phase region. $A_3$ for steels is the temperature of the boundary between the $\alpha$+$\gamma$ phase region and the $\gamma$ phase region. More preferably, the maximum temperature for application of the magnetic field will be no greater than $T_C$ plus 50° C. The strength of the magnetic field to be applied to the alloy will be greater than 2 T (depending on the alloy), preferably greater than 5 T, more preferably greater than 10 T, even more preferably greater than 20 T, and most preferably greater than 50 T. The magnetic field is believed to cause the alloy's phase boundary to shift by affecting the Gibb's free energies of the ferromagnetic phases. As a result of the phase boundary shift, new crystallization nuclei of the stabilized phase are formed thereby breaking existing grains into smaller equiaxed grains causing grain size refinement. This invention is based on magnetic field induced nucleation and growth of new grains. This is preferably induced by For steels, $\alpha$ is a phase that has a body centered cubic (BCC) crystalline structure (or some distortion of BCC) and is ferromagnetic below its Curie temperature, but becomes paramagnetic above its Curie temperature. A typical Curie temperature for carbon steels is about 770° C. Also for steels, $\gamma$ is another phase that has a face centered cubic (FCC) crystalline structure and is paramagnetic. These two phases have different densities.

Figure 2:
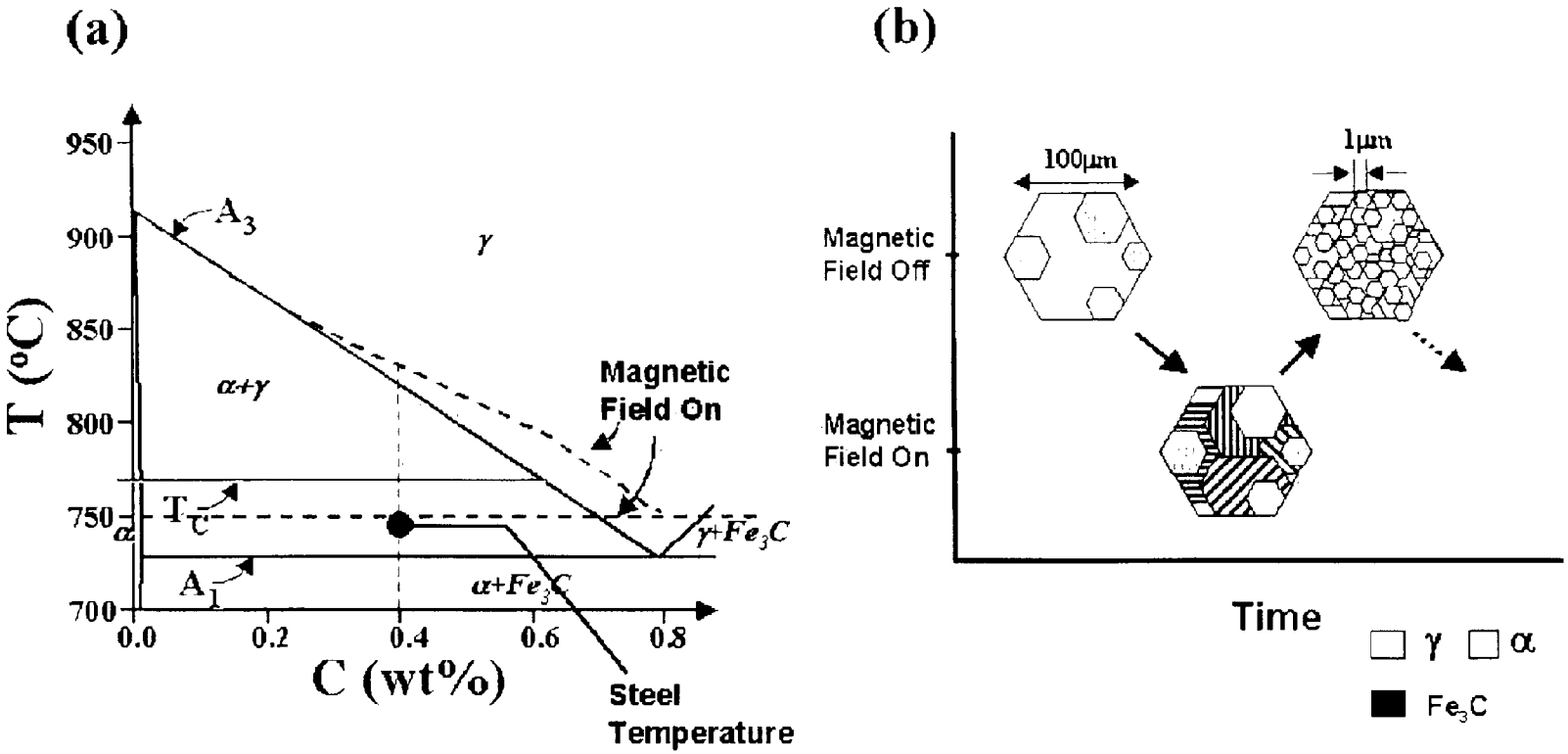
FIGS. 2 and 3 depict the present invention using Fe—C alloy (carbon steel) as an example.
Figure 3:
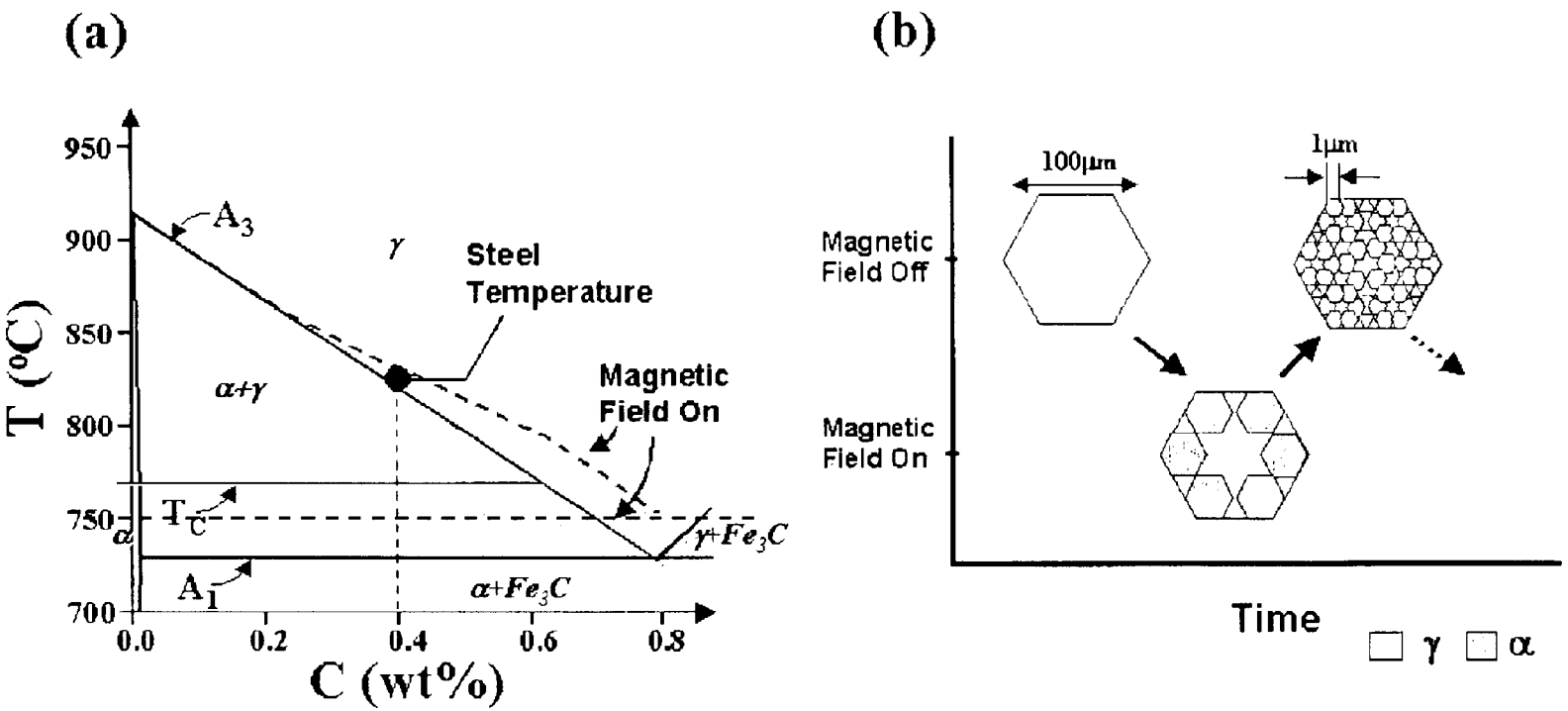

The invention is more easily understood by reference to the schematic Fe—C steel phase diagram shown in FIGS. 2 and 3. In the present invention, the alloy to be subjected to a magnetic field can initially be in any phase boundary region provided the initial phase boundary region is within $A_1$ to $T_C$+100° C. In this invention magnetic field-induced phase boundary shifting accomplish the advantageous phase transformations to maximize breaking up of initial coarse grain structures into fine crystallites/grains. One embodiment of the present invention involves applying or changing a magnetic field at a fixed temperature. In another embodiment of the present invention the temperature can be changed while applying a fixed or varying magnetic field. For example, a magnetic field can be applied while a steel alloy is cooling.

FIGS. 2 and 3 exemplify an application of the present invention. The phase boundary shift taught herein can be accomplished in the temperature range between the solid horizontal $A_1$ line and $T_C$+100° C. ($T_c$ is the Curie temperature). More preferably, this can be accomplished in the two temperature regions that are respectively above the $A_1$ as shown in FIG. 2, and close to the solid $A_3$ sloped line as shown in FIG. 3. At the lower temperature region near $A_1$, in the absence of a magnetic field, the steel undergoes a transition from $\alpha$+$\gamma$ two phase region to $\alpha$+$Fe_3C$ phases upon cooling from a temperature above $A_1$ through $A_1$. In the higher temperature region near $A_3$, in the absence of a magnetic field, the steel undergoes phase transition from the single phase $\gamma$ to two phases $\alpha$+$\gamma$ upon cooling from a temperature above $A_3$ through the $A_3$ temperature. The corresponding reverse phase transformations occur during heating through $A_1$ and $A_3$ temperatures, respectively. While cooling is the economically preferred process, similar heating schemes can also induce phase transition, though in the reverse direction. In FIGS. 2 and 3, the dashed lines depict schematically the shifted location of the $A_1$ and $A_3$ temperatures with the application of a magnetic field in accordance with the present invention. In FIG. 2(*a*) the solid circle at 0.4 wt % carbon and approximately 740° C., represents the initial steel condition before application of any magnetic field. Upon application of the magnetic field, the $A_1$ phase boundary is shifted upwards from the horizontal solid line to the horizontal dashed line. As a result of turning on the magnetic field, the steel held at constant temperature now is in the $\alpha+Fe_3C$ region instead of the $\alpha+\gamma$ region. By turning off the magnetic field, the steel is reverted back to the $\alpha+\gamma$ region. This process can be repeated multiple times as necessary. FIG. 2(*b*) depicts schematically the refinement of initial grain size upon repeated application and cessation of magnetic field to an Fe—C steel initially (as shown by the solid circle) at a temperature near the $A_1$ temperature. In FIG. 3(*a*) the solid circle at 0.4 wt % carbon and approximately 830° C., represents the initial steel condition before application of any magnetic field. Upon application of the magnetic field, the $A_3$ phase boundary is shifted upwards from the sloped solid line to the curved dashed line. As a result of turning on the magnetic field, the steel held at constant temperature now is in the $\alpha+\gamma$ region instead of the $\gamma$ region. By turning off the magnetic field, the steel is reverted back to the $\gamma$ region. This process can be repeated multiple times as necessary. The schematic in FIG. 3(*b*) depicts the refinement of initial grain size upon repeated application and cessation of the magnetic field to an Fe—C steel initially (as shown by the solid circle) at a temperature near the $A_3$ temperature.

Applicants believe that the shifting between two different phase ratios with the application of magnetic field allows for grain size refinement. Hence, for example, the alloy to be acted upon can be in the 100% $\gamma$ phase and as a result of application of the magnetic field can shift into a certain $\alpha$:$\gamma$ phase ratio and then back upon ceasing or reducing strength of the magnetic field applied; for example see FIG. 3. The alloy could likewise start out in the $\alpha+\gamma$ phase and be shifted to the predominantly $\alpha$ phase (with some $Fe_3C$) as a result of magnetic field and then back; for example see FIG. 2. All that is necessary is that the alloy be cycled between two points in the phase diagram that have different ratios (e.g., volume fractions) of $\alpha$ and $\gamma$ phases. The shift need not be between adjacent phase boundaries; it can also be accomplished by either or both of the following two techniques. First, by using the suitable alloy chemistry (e.g., adding alloying such as carbon), the temperature gap between $A_1$ and $A_3$ can be narrowed. For example, as seen in FIG. 2, using 0.7 wt % carbon creates a gap of only 20° C. Second, potentially with a very high magnetic field, it may be possible to shift across two phase boundaries. For example, as seen in FIG. 3, the predominant steel phase could be shifted from $\gamma$ to $\alpha+Fe_3C$ and then back to $\gamma$ or $\alpha+\gamma$. However, a steel alloy must initially be in the $\alpha+\gamma$ or $\gamma$ phase region prior to application of the magnetic field. Preferably, the alloy will be in the $\gamma$ phase region prior to application of the magnetic field, to take advantage of the faster phase transformation kinetics at higher temperature.

Figure 4:
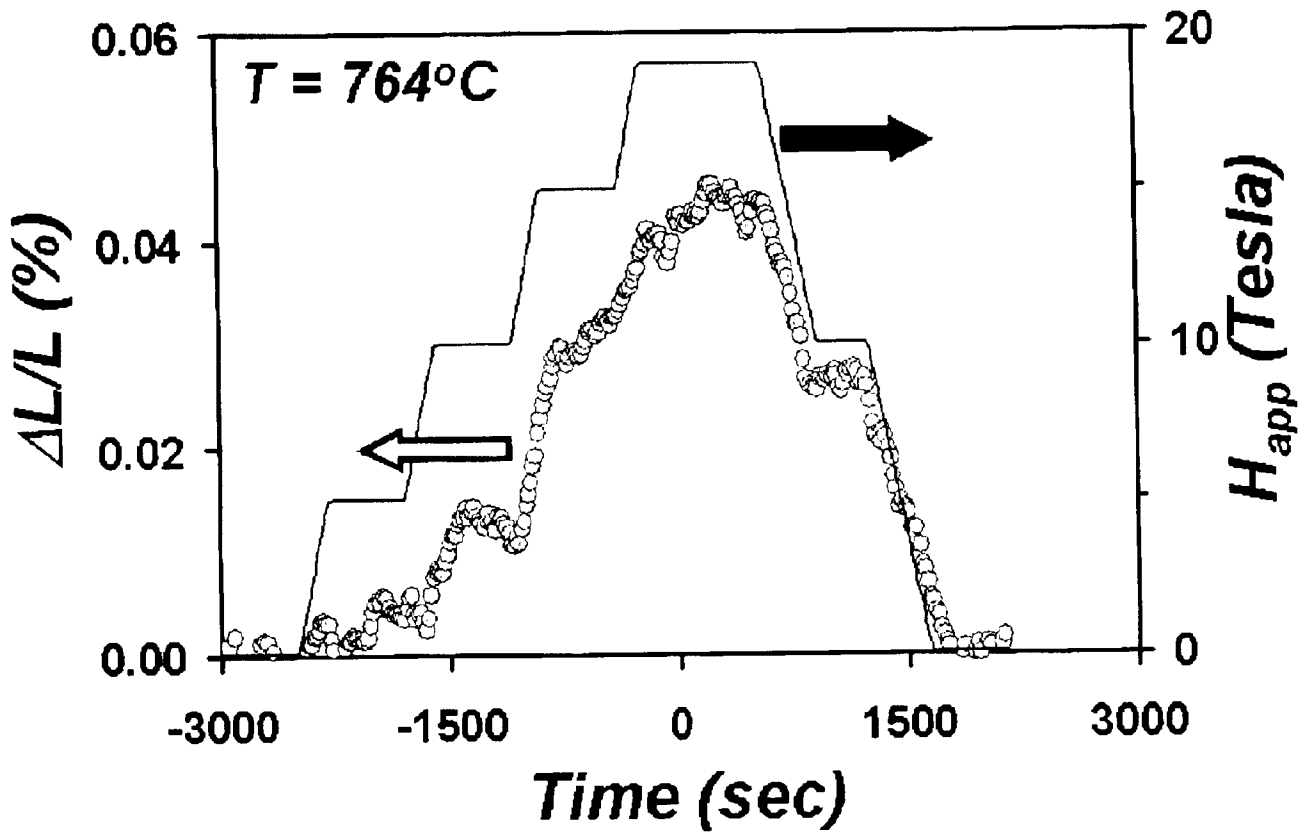
FIG. 4 shows example experimental results according to the present invention with an AISI 1018 carbon steel at a constant 764° C. temperature were the application and removal of magnetic field is plotted against duration of the exposure of the steel to the magnetic field. The magnetic field is ramped in steps to a maximum of 19 tesla (T). The circular data points are the experimentally measured linear % expansion data points using the dimension of the steel bar at 764° C. without the magnetic field as a reference point.

When an $\alpha$ phase forms at the expense of $\gamma$ phase in steels, the steel undergoes a dimensional change, in this example, an expansion due to the lower atom packing density of the body centered cubic (BCC) structure of the $\alpha$ phase compared to the higher atom packing of the face centered cubic (FCC) crystal structure of the $\gamma$ phase. Thus, the dimensional change can be monitored to gain an understanding of the phase(s) that are growing at the expense of other phase(s). FIG. 4 presents experimental data of measured dimensional change for AISI 1018 carbon steel, having a carbon content of about 0.18 wt %, when a magnetic field is applied in stages to ramp up to a maximum field strength of 19 T at a constant temperature of 764° C. At this temperature when the steel is equilibrated, the steel is in a two-phase $\alpha+\gamma$ phase region in the absence of a magnetic field. It can be seen that when the magnetic field is turned on, the steel specimen undergoes expansion, indicating the growth of $\alpha$ phase at the expense of $\gamma$ phase. The amount of $\alpha$ phase continues to increase up to the maximum magnetic field studied. It can be seen that ceasing the magnetic field can reverse the phase changes. The experiment provides confirmation that the phase stability can be influenced at a constant temperature by the application or cessation of a magnetic field. In the presence of a magnetic field, the thermodynamic stability of the ferromagnetic phase, $\alpha$, is increased leading to its nucleation and growth at the expense of the paramagnetic $\gamma$ phase. The application and cessation of the magnetic field can be repeated a number of times to obtain progressive grain refinement each time the field is applied and then ceased or cycled.

In order to provide maximum grain refining efficiency, it is preferable that at least 15 vol %, more preferably 30 vol %, even more preferably 50 vol % of the steel has gone through transformation with each cycle of the application of the magnetic field. To maximize grain refining, magnetic cycling (either on-off or changing field strength) can be applied.

Figure 5:
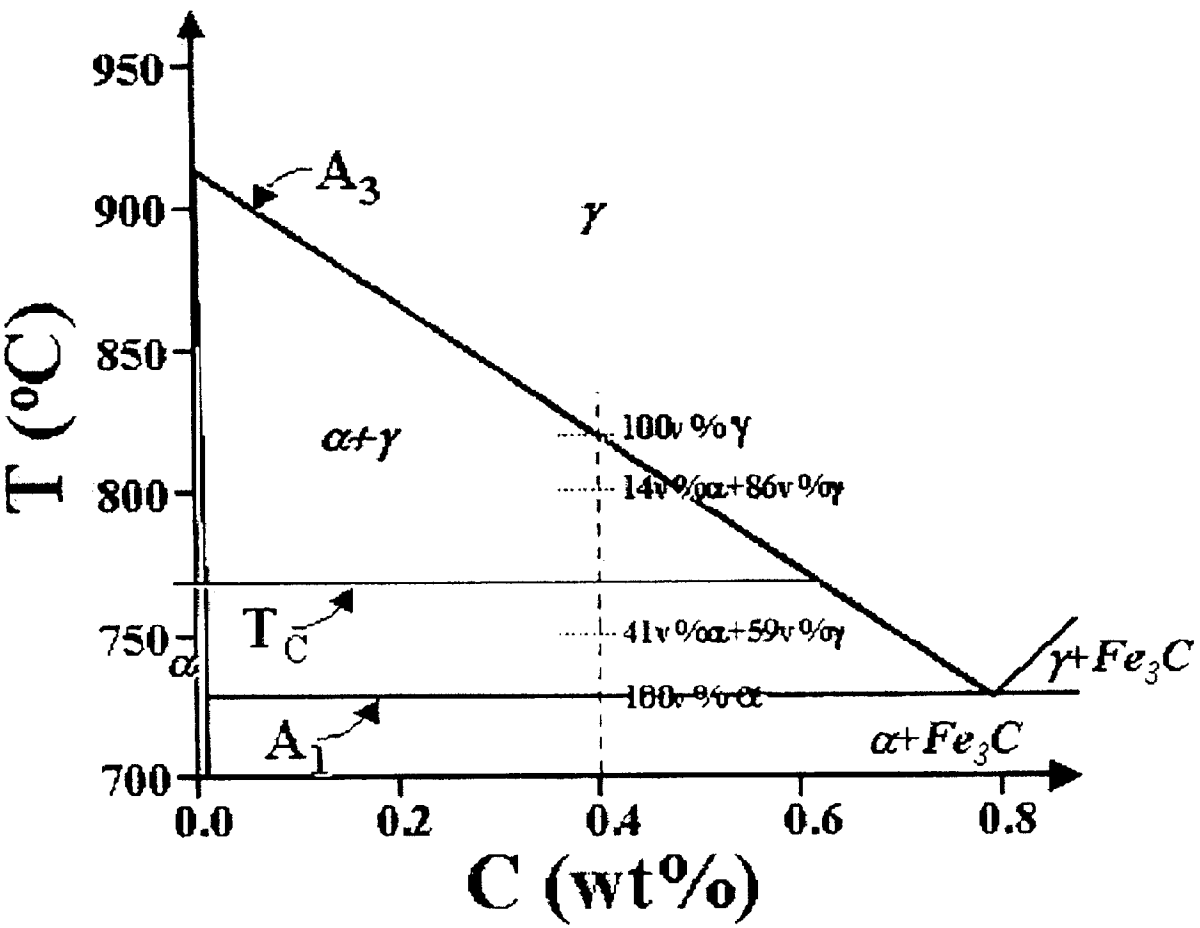
FIG. 5 shows the Fe—C phase diagram and examples of the preferred alloy composition range for practicing the current invention to maximize the grain refining effect.

A particular aspect of this invention is to couple suitable alloy chemistry design with the application of specific magnetic field strengths. This is illustrated in FIG. 5, which is a Fe—C phase diagram. As an example, if we use a steel chemistry having 0.4 wt % carbon (C), when the temperature is about $A_1$ (~730° C.), a shift of 20° C. achieved with the application of a magnetic field results in a change of greater than 50% change in the volume distribution of the phases. In this example, the steel is initially in the two-phase $\alpha+\gamma$ phase region at around 750° C. in the absence of a magnetic field. When the magnetic field of sufficient strength is applied to cause a 20° C. upward shift in phase boundary, about 55% by volume of the $\gamma$ phase are replaced with $\alpha$ phase (possibly with some $Fe_3C$). On the other hand, if we use a steel chemistry having a lower carbon content, such as with 0.2 wt % C, the same magnetic field induced 20° C. boundary shift results in only 28 vol % of the y phase replaced with $\alpha$ phase. Thus, the grain refining efficiency will be far more effective in the 0.4 wt % C steel than in the 0.2 wt % C steel. The amount of phase changes for a given magnetic field strength is a function of the alloy chemistry as it relates to magnetization. Within the general steel chemistry considerations known in the art, it is preferable in the present invention that an alloy chemistry be selected to maximize the amount of phase changes for a given shift in the phase boundary with the magnetic field application or cessation.

The minimum time for application of a magnetic field cycle is dependent on how long it takes for sufficient metal to transform into a different phase. The maximum time is limited by economics and the minimization of undesired grain growth. Ideally, the magnetic field is applied for a time sufficient to complete all the desired phase transformation per thermodynamic equilibrium, but short enough before the newly formed grains begin to grow. In practice, there is a compromise between these two requirements of transformation completion and grain growth.

For example, in a manganese steel having a chemistry of 0.43C–1.6 Mn, at $A_3$ (roughly 750° C.) has 100 vol % y phase (Condition A). A 50 T magnetic field is estimated to impart approximately a 50° C. upwards shift in the $A_3$ phase boundary resulting in a phase ratio of 25 vol % γ to 75 vol % α (Condition B) at thermodynamic equilibrium. It takes a long time to reach thermodynamic equilibrium. It takes roughly 5 seconds to complete about 5% of the transition from Condition A to Condition B. It takes roughly 40 seconds to complete about 50% of this transition from Condition A to Condition B. At this stage up to about 40 seconds the process is dominated by nucleation. It takes roughly 2000 seconds to complete about 80% of the transition from Condition A to Condition B. This later stage is dominated by growth of newly formed grains. Preferred times for application of this 50 T magnetic field (i.e., to complete about a 50% transition from Condition A to Condition B) are at least about 40 seconds (sec) and less than about 150 seconds (to avoid excessive growth).

Preferred times will depend on the alloy chemistry, alloy temperature, and amount of phase boundary shift (related to magnetic field strength). Generally, it is preferred to apply the magnetic field for a sufficient time period to maximize transformation while minimizing excessive grain growth. While dependent on the above variables, preferred application times for applying a magnetic field are about 0.1 to about 3000 seconds, more preferably for about 0.1 to about 1000 seconds, even more preferably about 1 to about 100 seconds. In one embodiment, this field is cycled with the off time about equal to the on time. In another embodiment, the off time is different from the on time. The examples herein are for illustrative purposes and are not meant to be exclusive or limiting.

Typical alloys which can be refined in accordance with the present invention include, but are not limited to, alloys of iron, nickel, cobalt, individually or in combination. In one of the preferred embodiments, the alloys will contain at least 92 wt % of iron, nickel, cobalt, or a combination thereof. This in these alloys, no more than 8 wt % of other components are present. Most preferably, iron alloys will be utilized as they represent technologically some of the most important alloy systems. Some examples of preferred materials include, but are not limited to, high strength low alloy steels such as API X80, ASTM A516 grade 60 or 70 and AISI grades 1010, 1018, 1020, 1040, 4120, 4130, or 4140. However, as should be obvious for those skilled in the art, the present invention is not limited to ferromagnetic steels, alloy steels, high strength low alloy steels, nickel alloys, and cobalt alloys. The invention is broadly applicable to alloys which undergo a magnetic transition such as ferromagnetic to paramagnetic transition.

The temperature of the phase boundaries as well the Curie temperature can be modified by alloy chemistry. Alloy chemistries are preferably designed to maximize phase ratio change with minimum phase boundary shift as shown above. For example, adding nickel or cobalt to steel can change its Curie temperature, whereas adding carbon does not. For example, adding nickel, carbon and/or nitrogen can depress $A_3$ temperature. With this disclosure one can construct a phase diagram that shows the phase region boundaries for any given alloy to design a magnetic procedure according to the invention. For instance, this may be accomplished using THERMO-CALC software (Thermo-Calc AB, Stockholm, Sweden).

The magnetic field to be applied will be of sufficient strength to cause a shift in phase boundary preferably at least by about 10° C., more preferably at least by about 20° C., and even more preferably at least by about 50° C. In steel, a one T magnetic field roughly causes a one degree Celsius shift of the $A_1$ and $A_3$ phase boundaries. The magnetic field may be applied for a sufficient time to complete a percentage of the expected phase transformation. It is preferable to achieve transformation of at least about 15 vol %, more preferably at least about 30 vol %, and even more preferably at least about 50 vol % of the alloy. The maximum time the field will be applied is a time which is shorter than the time required to induce grain growth for that alloy. Hence, the strength of the magnetic field will be at least about 2 T (for certain alloys), preferably at least 10 T, more preferably at least about 20 T, even more preferably at least about 50 T. Increasing the number of magnetic field cycles (when each cycle is applied for sufficient times to achieve a percentage of the expected phase transformation), generally leads to more refinement. Although the magnetic field is preferably ceased for as long as it takes for the alloy to return substantially to its initial phase ratio (and dimensions), shorter or longer cessation times are possible. The refinement of the alloy during the process of this invention can be monitored by dimensional change similar to that depicted in FIG. 4. Hence, the one can determine how long the field should be applied and ceased during each cycle or repeat of steps (a) and (b). If the magnetic field is simply decreased in strength, the amount of time before the magnetic field strength is increased again will preferably be that amount of time required for the alloy to reach phase (and dimensional) equilibrium. In practice, however, this time may be shorter, but the maximum benefit will be recognized when at least about least 15 vol %, more preferably at least about 30 vol %, even more preferably at least about 50 vol % of the of the alloy has undergone phase transformation.

What is claimed is:

1. A method for refining the grain size of an alloy which undergoes a magnetic field induced phase transformation, comprising:

(a) subjecting the alloy to a uniform magnetic field of a sufficient strength and for a time sufficient to cause the alloy to transition from a first phase ratio to a second phase ratio; and (b) decreasing the uniform magnetic field to allow the alloy to transition from the second phase ratio to a third phase ratio, wherein the third phase ratio may be the same or different from the first phase ratio; and (c) repeating steps (a) and (b), to produce an alloy having equiaxial grain size of less than about 10 microns.

2. A method according to claim 1, wherein the alloy is selected from the group consisting of steel, iron alloys, cobalt alloys, and nickel alloys;

the decrease of the uniform magnetic field in (b) reduces the uniform magnetic field to about zero T; and the third phase ratio is the same as the first phase ratio.

3. A method according to claim 2, wherein the alloy contain at least 92 wt % of iron, cobalt, nickel, or a combination thereof.

4. A method according to claim 1, wherein the first phase ratio and the second phase ratio are in adjacent phase boundary regions.

5. A method according to claim 1, wherein the application of the uniform magnetic field is increased and decreased as single step changes.

6. A method according to claim 1, wherein the uniform magnetic field has a strength greater than about 5 T.

7. A method according to claim 1, wherein the alloy changes temperature by no greater than about +/−50° C. during the method.

8. A method according to claim 1, wherein the method is performed at an approximately fixed temperature.

9. A method according to claim 3, wherein the first phase ratio is at a temperature within the range of of about $A_1$ to about $T_c$+100° C.

10. A method according to claim 1, further comprising a cooling step (c) to cool the alloy to below about 500° C.

11. A method according to claim 1, further comprising a hot working step (d).

12. A method according to claim 1, wherein the alloy is a high strength low alloy steel comprising at least about 92 wt % Fe.

13. A method for refining the grain size of an alloy, comprising:

a ferromagnetic phase and a paramagnetic phase separated by a phase boundary, comprising:

(a) subjecting the alloy with a first volume ratio of the ferromagnetic phase and the paramagnetic phase, to a uniform magnetic field of sufficient strength to cause the temperature of the phase boundary to shift upwards, and a sufficient time to change the first volume ratio to a second volume ratio such that the uniform magnetic field causes at least about 15 vol % of the alloy to transform from the paramagnetic phase to the ferromagnetic phase;

(b) decreasing the uniform magnetic field to allow the alloy to transition to a third volume ratio wherein the third volume ratio may be the same or different from the first volume ratio; and (c) repeating steps (a) and (b) to produce an alloy having equiaxial grain size of less than about 10 microns.

14. A method for refining the grain size of an alloy, comprising:

a ferromagnetic phase and a paramagnetic phase separated by a mixed phase region having a lower phase boundary and an upper phase boundary, comprising:

(a) subjecting the alloy with a first volume ratio of the ferromagnetic phase and the paramagnetic phase, to a uniform magnetic field of sufficient strength to cause the temperature of the phase boundary to shift upwards, and a sufficient time to change the first volume ratio to a second volume ratio such that the uniform magnetic field causes at least about 15 vol % of the alloy to transform from the paramagnetic phase to the ferromagnetic phase;

(b) decreasing the uniform magnetic field to allow the alloy to transition to a third volume ratio wherein the third volume ratio may be the same or different from the first volume ratio; and (c) repeating steps (a) and (b) to produce an alloy having equlaxial grain size of less than about 10 microns.

15. A method according to claim 1, 13 or 14 wherein the method produces equiexial grains having a mean grain size of less than about 5 micrometers at the end of the method.

16. A method according to claim 14, wherein the third volume ratio is the same as the first volume ratio.

17. A method according to claim 14, wherein the alloy is a iron, nickel, or cobalt alloy.

18. A method according to claim 17, wherein the alloy is a low alloy steel with a total amount of alloying less than about 8 wt %.

19. A method according to claim 18, wherein the steel is a member selected from the group consisting of API X80, ASTM A516 grade 60, ASTM A516 grade 70, AISI grade 1010, AISI grade 1018, AISI grade 1020, AISI grade 1040, AISI grade 4120, AISI grade 4130, and AISI grade 4140.

20. A method according to claim 19, wherein the alloy is a steel;

in step (a), the uniform magnetic field is at least about 10 T and is applied for a time of about 0.1 seconds to about 1000 seconds;

in step (b) the uniform magnetic field is decreased to about zero T for a time of about 0.1 seconds to about 1000 seconds; and the temperature is between about $A_1$ and about $T_c$+100° C.

21. A method according to claim 20, wherein in step (a), the uniform magnetic field is at least about 20 T and is applied for a time of about 1 second to about 100 seconds.

22. A method according to claim 21, wherein the uniform magnetic field is cycled from 2 to about 10 times wherein the time between magnetic cycles is about 0.1 seconds to about 1000 seconds independently of the time in step (a).

* * * * *